US006619248B1

(12) United States Patent
Bertelshofer et al.

(10) Patent No.: US 6,619,248 B1
(45) Date of Patent: Sep. 16, 2003

(54) DEVICE FOR ALTERING THE CONTROL TIMING OF GAS EXCHANGE VALVES OF AN INTERNAL COMBUSTION ENGINE, ESPECIALLY AN APPARATUS FOR HYDRAULIC ROTATIONAL ANGLE ADJUSTMENT OF A CAMSHAFT RELATIVE TO A CRANKSHAFT

(75) Inventors: Thomas Bertelshofer, Ebermannstadt (DE); Gerd Wiessner, Neustadt/Aisch (DE); Jurgen Schwab, Rottenbach (DE); Thomas Kleiber, Hirschaid (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/194,760

(22) Filed: Jul. 12, 2002

Related U.S. Application Data

(60) Provisional application No. 60/373,254, filed on Apr. 17, 2002.

(51) Int. Cl.[7] ..... F01L 1/34

(52) U.S. Cl. ..... 123/90.15; 123/90.17; 123/90.27; 123/90.31; 251/12; 464/160

(58) Field of Search ..... 123/90.15, 90.16, 123/90.17, 90.18, 90.27, 90.31; 464/1, 2, 160; 251/12, 14

(56) References Cited

U.S. PATENT DOCUMENTS 5,337,711 A * 8/1994 Hampton ..... 123/90.17
5,377,639 A * 1/1995 Nakadouzono et al. .. 123/90.17
5,566,651 A * 10/1996 Strauss et al. ..... 123/90.17
5,713,319 A * 2/1998 Tortul ..... 123/90.17
5,765,517 A * 6/1998 Wiehl ..... 123/90.17
5,927,239 A * 7/1999 Kohrs et al. ..... 123/90.17
6,039,016 A * 3/2000 Noguchi ..... 123/90.17
6,155,219 A * 12/2000 Fukuhara et al. ..... 123/90.17
6,405,695 B2 * 6/2002 Mizutani et al. ..... 123/90.17
6,453,859 B1 * 9/2002 Smith et al. ..... 123/90.17

* cited by examiner

*Primary Examiner*—Thomas Denion
*Assistant Examiner*—Ching Chang
(74) *Attorney, Agent, or Firm*—Volpe and Koenig, P.C.

(57) ABSTRACT

A device (1) for hydraulic rotational angle adjustment of a camshaft relative to a crankshaft of an internal combustion engine including a drive unit (4) connected with the crankshaft and an output unit (5) non-rotatably connected with the camshaft. The drive unit (4) stands in power transmitting connection with the output unit (5) through at least two pressure chambers (6, 7) formed inside the device (1) which bring about, under action by pressure under continuous compensation for external pressure leakages, a relative rotation or a hydraulic clamping of the output unit (5) in relation to the drive unit (4). In addition, the device (1) has a coil spring (8) arranged outside the device which is provided for adaptation of its adjustment speeds in both adjustment directions. The coil spring (8) is arranged via enclosure in an additional housing (11) in a closed annular space which is completely fillable with the external pressure medium leakages of the device (1), whereby the hydraulic pressure medium acts at the same time as a damping agent against sympathetic resonant vibrations of the spring turns (13) of the coil spring (8) resulting from vibrations of the internal combustion engine.

8 Claims, 2 Drawing Sheets

DEVICE FOR ALTERING THE CONTROL TIMING OF GAS EXCHANGE VALVES OF AN INTERNAL COMBUSTION ENGINE, ESPECIALLY AN APPARATUS FOR HYDRAULIC ROTATIONAL ANGLE ADJUSTMENT OF A CAMSHAFT RELATIVE TO A CRANKSHAFT

CROSS-REFERENCE TO RELATED APPLICATIONS

This application claims the benefit of U.S. Provisional Application No. 60/373,254, filed Apr. 17, 2002.

BACKGROUND

The invention relates to a device for altering the control times of gas exchange valves of an internal combustion engine, especially an apparatus for hydraulic rotational angle adjustment of a camshaft relative to a crankshaft, in which the device is arranged on the drive side end of a camshaft mounted in the cylinder head of the internal combustion engine and is basically constructed as hydraulic actuator controllable as a finction of various operating parameters of the internal combustion engine. The device includes a drive unit drivingly connected with a crankshaft and bounded axially by two lateral covers as well as of an output unit connected in a rotationally fast manner to a camshaft and inserted into the drive unit. The drive unit of the device is connected to provide power transmission to the output unit of the device through at least two pressure chambers formed inside the device, which are alternatively or simultaneously acted upon by a hydraulic pressure medium, The action of pressure in the pressure chambers takes place under constant compensation for external pressure medium leakages and brings about a relative twisting or a hydraulic clamping of the output unit in relation to the drive unit. For adapting the adjustment speed of the device in both adjustment directions as well as for attaining a preferred position of the output unit toward the drive unit for the start of the internal combustion engine, the device has a spring apparatus constructed as a coil spring arranged outside the device in front of a lateral cover of the drive unit which is fastened with one end on the drive unit and with the other end on the output unit, and it is especially advantageously realizable on an apparatus for hydraulic rotational angle adjustment of a camshaft relative to a crankshaft.

From DE 100 01 200 A1, a representative device for altering the control times of the gas exchange valves of an internal combustion engine is known which is arranged on the drive-side end of a camshaft mounted in the cylinder head of an internal combustion engine and is constructed, depending upon various operating parameters of the internal combustion engine, of controllable hydraulic actuators. This device basically includes a drive unit drivingly connection with the crankshaft and axially bounded by two walls, as well as an output unit connected in a rotationally fixed manner with the camshaft and inserted into the drive unit, which stand in power transmitting connection through at least two pressure chambers pressure chambers constructed within the device which are alternatively or simultaneously subject to action by a hydraulic pressure medium. The drive unit is formed in connection with this device by a hollow cylinder drive gear constructed with exterior teeth in which, due to radial partitions, several hydraulic operating spaces arise. Correspondingly, with this device, an impeller is provided as output unit which is constructed with several vanes extending radially away from its wheel hub which subdivide the operating spaces in the drive unit into at all times two of the hydraulic pressure chambers mentioned. When these pressure chambers are acted upon by pressure, there consequently arises (with constant compensation for external pressure medium leakage) a relative rotation or a hydraulic clamping of the output unit of the device, and therewith of the camshaft in relation to the crankshaft of the internal combustion engine. In addition, this device has, for adapting their adjustment speeds in both adjustment directions as well as for reaching a preferred position of the output unit in relation to the drive unit for starting the engine, a spring apparatus which is constructed as a coil spring arranged outside the device adjacent to a side cover of the drive unit and fastened with one end on the drive unit and with the other end on the output unit.

With this known device, it has nonetheless turned out in practice that the coil spring used is excited to sympathetic vibrations on the basis of its free arrangement outside the device by the vibrations emitted by the internal combustion engine. If the coil spring then oscillates in its resonant frequencies, in an unfavorable case oscillation amplitudes of such magnitude occur that the excess tension elevations lead to breakage of the coil spring. With an altered winding of the coil spring, the resonance frequency can indeed be diminished by restricting the path of the spring turn available for oscillation. But such measures have not proved sufficient for designing the coils springs secure against breakage.

SUMMARY

For this reason, the object is to provide a device for altering the control times of gas exchange valves of an internal combustion engine, especially an apparatus for hydraulic rotational angle adjustment of a camshaft in relation to a crankshaft, where without impairing the function of the device as well as without alterations of the structural space of the device, using simple means, an oscillation of the coil spring excited by vibrations of the internal combustion engine in its resonant frequencies, and an oscillation breakage of the coil spring therewith, is avoided.

This object is accomplished with a device according to the invention in such a way that the coil spring arranged outside the device is arranged using an additional housing in a closed annular space formed together with the adjacent side cover of the drive unit through encapsulation, which in interaction with the centrifugal forces arising in the operation of the internal combustion engine, is completely fillable with the external pressure medium leakage from the device, and out of which the hydraulic pressure medium is once again dissipatable as leakage, whereby when the annular space is completely filled, the hydraulic pressure medium functions at the same time as a damping agent against the resonant frequencies of the spring turns of the coil spring resulting from vibrations of the internal combustion engine.

In a preferred aspect of the device constructed in accordance with the invention, the additional housing is made of a cup-like housing cover into the base of which a coaxial circular opening is provided, which forms the outer bounding walls of the annular space, as well as well as of a casing-like housing hub which is insertable into the circular opening in the housing cover and which forms the internal boundary wall of the annular space. The two part construction of the additional housing has proven to be particularly advantageous with respect to the economical manufacture of the housing parts as stamped-drawn parts as well as with respect to fastening the ends of the coil spring on the one hand on the drive unit and on the other on the output unit. Nevertheless, a more than two part construction of the housing is also possible, along with its manufacture in non-cutting formed or a machined part.

An further advantageous configuration of the cup-like housing cover of the device constructed in accordance with the invention includes a circumferential wall which has an inner diameter corresponding approximately to the outer diameter of the adjacent side cover of the drive unit as well as a lengthened edge part with which the housing cover is affixable on the side cover of the drive unit. The circumferential wall is here preferably bent at right angles to the base of the housing cover and, due to the lengthened edge part, has a height which goes slightly beyond the width of the coil spring arranged in the annular space.

For affixing the housing cover on the lateral cover of the drive unit, the housing cover has in further configuration of the invention a circular step in its circumferential wall which lies face-side on the lateral cover of the drive unit and consequently on the one hand forms an axial stop for the housing cover to avoid an axial clamping of the coil spring arranged on the housing, and on the other hand centers the housing cover toward the lateral cover of the drive unit. Through several detents distributed uniformly in the circumference in the extended edge part of the circumferential wall of the housing cover which extend behind the lateral cover of the drive unit, the housing cover is then fastened form-locking on the lateral cover of the drive unit as well as secured axially against unintentional separation. The free space necessary for the detents can then be created either through a circular perforation into the adjacent edge part of the housing surface of the drive unit or through a lateral cover of the drive unit slightly larger in diameter than the drive unit. As an alternative to this, it is also possible to work only local depressions into the edge part of the housing surface of the drive unit which are arranged at the same distance as the detents on the housing cover toward one another and have at least their breadth so that the housing cover is additionally protected against torsion. To avoid pressure medium leakages at this connection point, it has moreover proven advantageous to place between the step in the circumferential wall of the housing cover and the lateral cover of the drive unit an annular seal of rubber or plastic which (in connection with fastening the housing cover over the detents in its circumferential wall) is axially braced between the housing cover and the drive unit. Alternatively, the attachment of the housing cover on the lateral cover of the drive unit can be a press fit, and consequently seal off the connection point between the housing and the lateral cover without additional sealant radially against pressure medium leakages.

The casing-like housing hub of the device constructed according to the invention has, in an advantageous configuration, a cylinder wall with an outer diameter approximately corresponding to the inner diameter of the circular opening in the housing cover which is constructed for retaining the housing hub on the drive unit on its face with a bend directed inwardly. In this way, an annular base is formed on the housing hub through which a central screw installed into the housing hub can be passed, with which the housing hub together with the output unit of the device is screwed on the camshaft. In its axial length, the housing hub is constructed such that it projects with its other face slightly out of the circular opening in the housing cover and closes this off toward the outside through a bend in its edge part. Since the housing hub, through its fastening on the output unit, is connected fast with the camshaft, this edge part projecting out of the housing cover can be used especially advantageously for fastening further components necessary for the finction of the device, for example through connection with an impulse-generating disk of an apparatus for ascertaining the camshaft position in relation to the crankshaft position or the like.

A further feature of the casing-like housing hub of the device constructed according to the invention is that its cylinder wall is partially constructed as a hollow square on which the complementarily constructed inner end of the coil spring is fastened form-locking. This especially concerns the part of the cylinder wall arranged inside the annular space of the housing and means that the inner end of the coil spring is preferably shaped such that it surrounds at least three sides of the hollow square of the housing hub and consequently arrests the coil spring through a form locking torsion-resistant connection to the housing hub as well as through this once again toward the output unit of the device. The diameter of the hollow cylindrical part of the housing hub and the lateral length of the hollow square of the housing hub are here preferably constructed identically and correspond approximately to the diameter of the screw head of the central screw with which the housing hub and the output unit are screwed on the camshaft. It is also possible to provide the diameter of the housing hub and the lateral length of the hollow square with different dimensions, or to provide the housing hub with another polygonal hollow section cross section on which the inner end of the coil spring then is in any given case complementarily adapted for form-locking fastening on the housing hub. Likewise, the housing hub can be constructed as a hollow cylinder over its entire length, and be fastened to the inner end of the coil spring constructed in this case without additional deflections through a rivet or screw connection or the like force-locking on the housing hub.

The outer end of the coil spring is, in a further configuration of the device constructed in accordance with the invention, preferably constructed with a bent hook-like shape and attached form-locking on a point of suspension projecting axially away on the drive unit of the device. It has proven especially advantageous to construct this point of suspension for the outer end of the coil spring through a component arranged in any case on the drive unit of the device, as for example, with rotation piston adjusters through an extended fastening screw on the lateral cover of the drive unit, whereby nonetheless points of suspension can also be arranged on the drive Unit especially for the spring attachment. Likewise, it is also possible here to construct the outer end of the coil without additional deflections, and to fasten it through a rivet or screw connection of the like force-locking on the drive unit of the device.

Finally, as a further feature of the device constructed in accordance with the invention, the external pressure medium leakages of the device are selectively discharged through slot seals between the drive unit and the output unit to a coaxial opening in the side cover of the drive unit adjacent to the housing and are from there introduced into the annular space of the housing through an annular slot between the opening in the lateral cover and the exterior of the housing hub. These external pressure medium leakages occur due to construction in all known hydraulic devices for rotational angle adjustment of a camshaft, whereby the volume and pressure loss associated therewith in the hydraulic pressure spaces of the device are permanently compensated by a corresponding control unit of the device. In this way, there occurs in operating the internal combustion engine a continual leakage flow which is diverted, at least in chain or gear driven devices, usually directly into the cylinder head of the internal combustion engine, but with the device constructed in accordance with the invention is at least caught in the additional housing. The pressure medium leakages caught are here completely pressureless and flow on the path described into the housing until the annular space formed in this is completely filled, and the spring turns of the coil spring are enclosed by the pressure mediums on all sides. The pressure medium situated between the spring windings must consequently be permanently displaced when the spring rises, and through its viscosity brings about a damping of spring vibrations. Through an additional annular slot between the housing cover and the housing hub, the pressure medium leakages are then diverted in a known manner out of the housing again into the cylinder head of the internal combustion engine, whereby it is alternatively also possible to conduct the supply and/or discharge of the pressure medium leakages into and out of the housing through inlets and outlets independently provided for this.

The device constructed in accordance with the invention for altering the control times of gas exchange valves of an internal combustion engine, especially an apparatus for hydraulic rotational angle adjustment of a camshaft relative to a crankshaft, consequently has the advantage in relation to the devices known from the state of the art that the coil spring arranged outside the device in front of one of the lateral covers on the drive unit by means of encapsulation through an additional housing, which is fillable with the pressure medium leakages present in any case, is now no longer arranged free, but rather is enclosed on all sides by the hydraulic pressure medium of the device, and consequently is hydraulically dampened in its sympathetic vibrations excited on the basis of vibrations from the internal combustion engine. In this way, the oscillation amplitudes are reliably kept so low that no excess tensions occur in the spring turns, and in any case, a vibration breakage of the coil springs is avoided. Moreover, a damping of this type has proven to be durable and in addition has the advantage that the function of the device is not influenced and that the additional housing requires no changes in the space available for the device.

BRIEF DESCRIPTION OF THE DRAWINGS

The invention will be explained in greater detail on the basis of a preferred embodiment which is schematically represented in the associated drawings, wherein.

DETAILED DESCRIPTION OF THE PREFERRED EMBODIMENT

Figure 1:
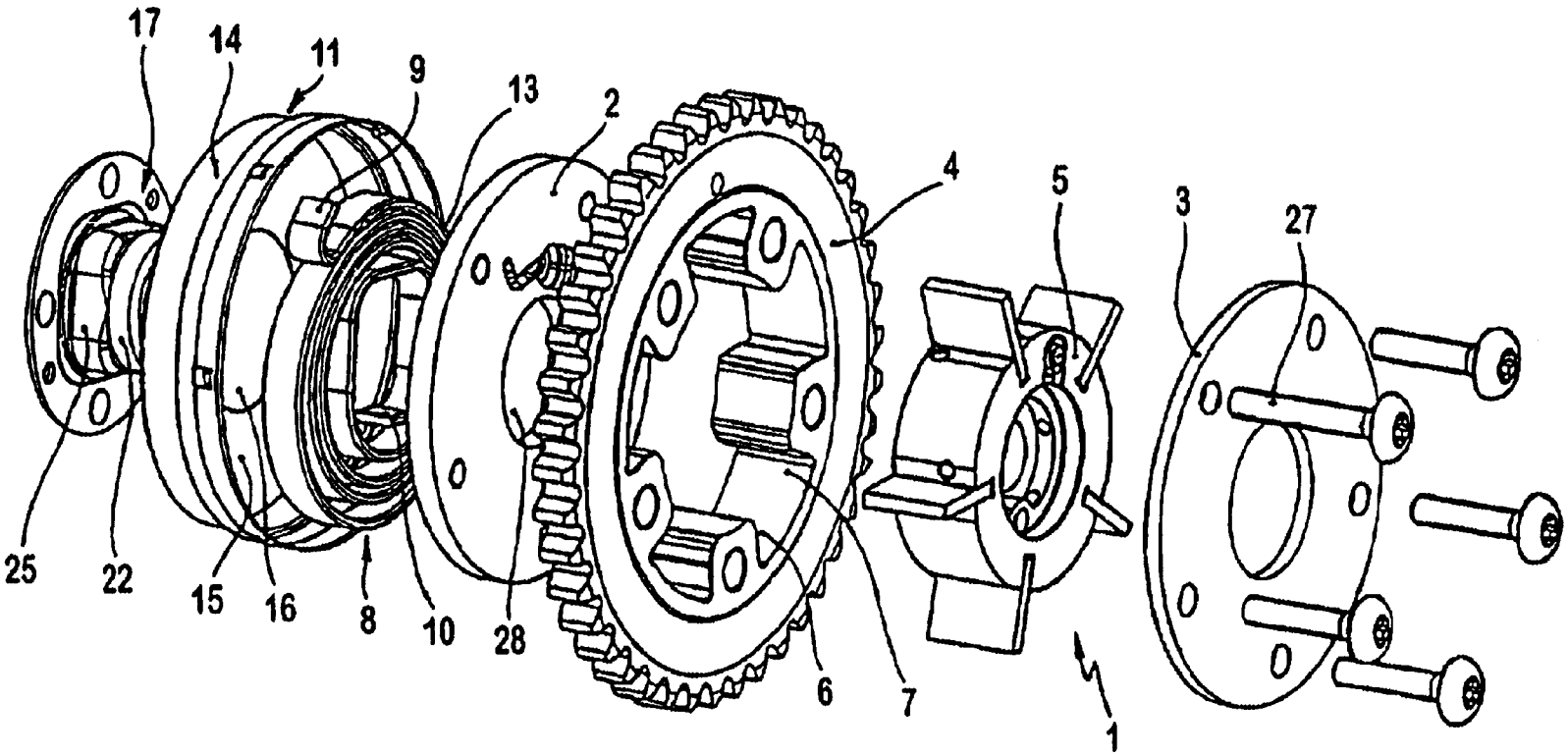
FIG. 1 is an exploded view of the device constructed in accordance with the invention.
Figure 2:
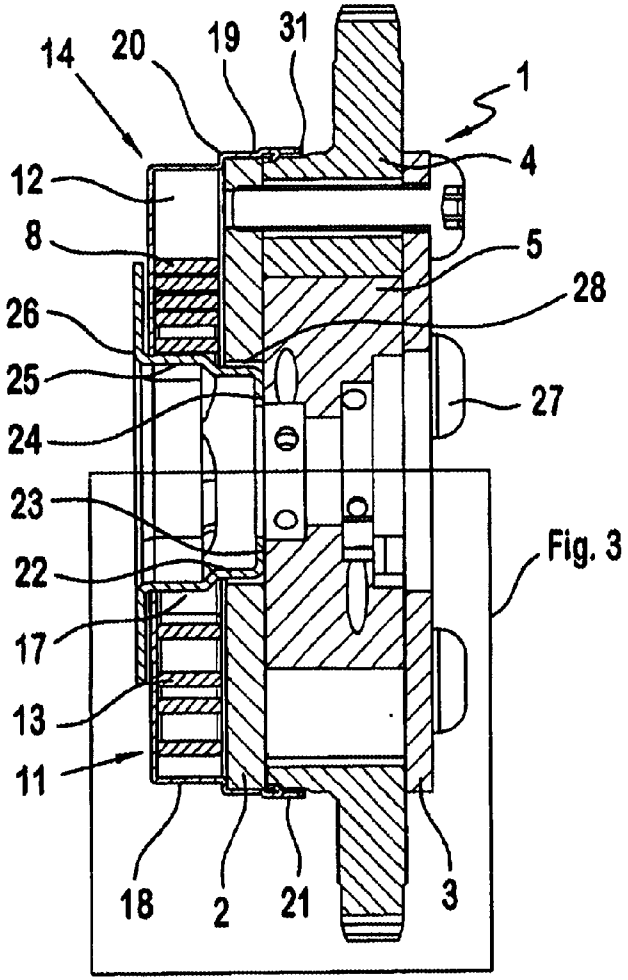
FIG. 2 is a longitudinal cross-sectional view through the device constructed in accordance with the invention.

From FIGS. 1 and 2, a device 1 for altering the control times of gas exchange valves of an internal combustion engine is shown which, for example, is constructed as a vane-cell adjustment apparatus for hydraulic rotational angle adjustment of a camshaft relative to a crankshaft and is controllable as a function of various operating parameters of the internal combustion engine. The device 1 is fastened to the drive-side end of camshaft (not represented in the drawings) mounted in the cylinder head of an internal combustion engine, and basically includes a drive unit 4 that is connected to the crankshaft (not shown) as well as an output unit 5 non-rotatably connected to the camshaft.

It is apparent especially through the exploded view of the device in FIG. 1 that the drive unit 4 is formed by a drive wheel with two lateral covers 2, 3, axially restricted and constructed with an external gearing, in which several hydraulic spaces are formed via several partitions. The output unit 5 of the device 1 is formed by an impeller insertable in the drive unit 4 which is constructed with several radially outwardly extending vanes connected to a wheel hub. These vanes subdivide the working spaces in the drive unit 4 into in each case two hydraulic pressure chambers 6, 7 which the drive unit 4 and the output unit 5 of the device 1 are held, through alternative or simultaneous action of pressure in the chambers, in force transmitting connection through a hydraulic pressure medium. The action of pressure of pressure chambers 6, 7 consequently brings about a relative rotation or a hydraulic clamping of the output unit 5 in relation to drive unit 4 and therewith the camshaft in relation to the crankshaft, whereby between the drive unit 4 and the output unit 5, construction-related pressure medium leakages arise which are passed out of the device 1 and are constantly compensated for.

In addition, the device 1 has, for adapting its adjustment speed in both adjustment directions as well as for attaining a preferred position of the output unit during starting of the internal combustion engine, a spring apparatus acts against the camshaft oscillating torque, which is clearly visible in FIG. 1 as a coil spring 8 fastened arranged outside the device 1 in front of the lateral cover 2 of the drive unit 4 as well as with an end 9 on the drive unit 4 and is constructed with the other end 10 on the output unit 5.

Figure 3:
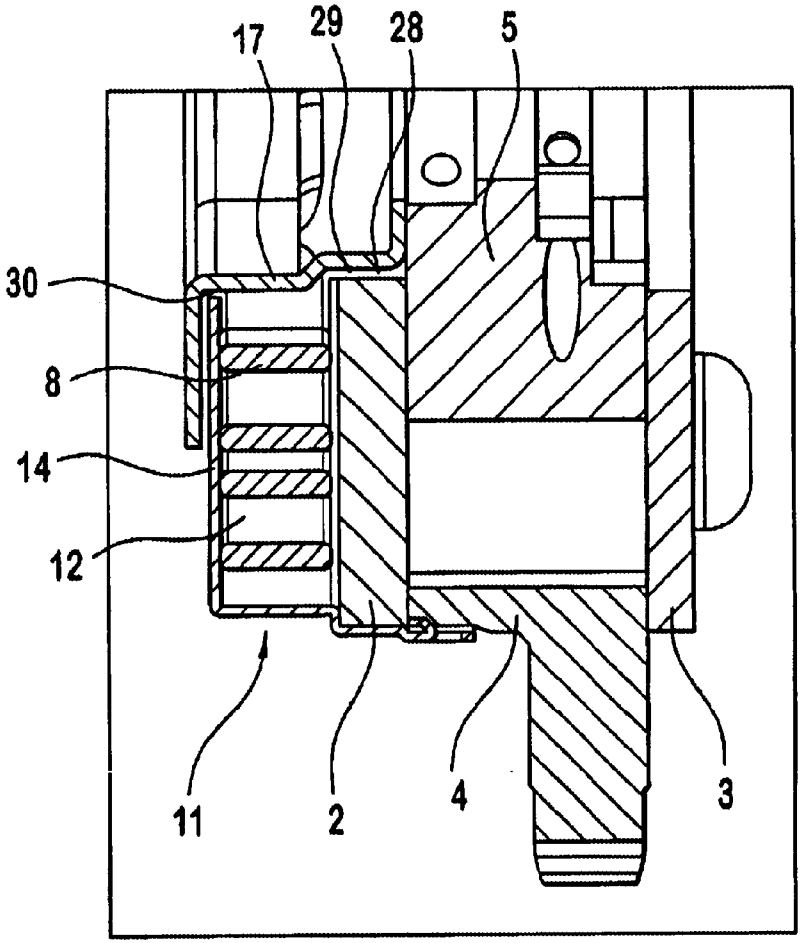
FIG. 3 is an enlarged view of detail X indicated in FIG. 2.

Since the coil spring 8 arranged outside the device 1 is excited by the vibrations emitted by the internal combustion engine to sympathetic resonant vibrations which can lead to breakage of the coil spring 8, it is arranged in accordance with the invention in a closed annular space 12, as can be seen in FIGS. 2 and 3, which arises through enclosing of the coil spring 8 by an additional housing 11 especially represented in FIG. 1 together with the adjacent lateral cover 2 of the drive unit 4. In this closed annular space 12, the external pressure medium leakages of the device 1 are first of all collected until the hydraulic pressure medium fills the annular space 12 in the housing completely from radially outward to radially inward due to the centrifugal forces acting in the operation of the internal combustion engine, and subsequently is carried off out of this once again as pressure medium leakage. When the annular space 12 is completely filled, the spring turns 13 of the coil spring 8 are consequently enclosed on all sides with the hydraulic pressure medium so that the nevertheless existing pressure medium leakages of device 1 act as damping agents against covibrations of the coil spring 8 arising from vibrations of the internal combustion engine.

In a preferred embodiment, the additional housing 11 is formed, as illustrated in FIG. 1, of a cup-like housing cover 14 with a coaxial circular opening 16 worked into its base, and of a housing hub 17 insertable into this circular opening.

The cup-like housing cover 14 here has a circumferential wall, noted with reference number 18 in FIG. 2, which is bent at right angles to the base 15 and has an internal diameter corresponding approximately to the outer diameter of the adjacent side cover 2 of drive unit 4. Through an extended edge part 19 of this circumferential wall 18, the housing cover 14 is then affixable on the lateral cover 2 of drive unit 4 since this is centered with a circular step 20 with a reduced diameter in its circumferential wall 18 on the lateral cover 2 and is fastened form-locking on this on this through several detents 21 evenly distributed on the circumference in the edge part 19 of the circumferential wall 18, which extend behind the lateral cover 2 as well. The necessary free space for the detents 21 is created here by a circular perforation 31 into the adjacent wall part of the jacket surface of the drive unit 4.

The casing-like housing hub 17 includes, as is likewise apparent from FIG. 2, a cylinder wall 22 with an outer diameter corresponding to the internal diameter of the circular opening 16 in the housing cover 14, which is constructed for affixing the housing hub 17 to the output unit 5 on its one face 24 with an inwardly directed bend 23. A central screw which is not represented in the drawings is then passed through the annular base formed thereby to fasten the housing hub 17 together with the output unit 5 of the device 1 onto the camshaft. With its other face 26, the housing hub 17 projects slightly out of the annular opening 16 in the housing cover 14 to close it off through an outwardly directed bend of the edge part.

Furthermore, it is apparent in FIGS. 1 and 2 that the cylinder wall 22 of the housing hub 17 is constructed inside the annular space 12 in the housing 11 in the shape of a hollow square 25 on which the complementarily constructed inner end 10 of the coil spring 8 is fastened in a form-locking manner. For this purpose, the inner end 10 of the coil spring 8 is shaped such that it lies on all four sides of the hollow square 25 of the housing hub 17, as illustrated in FIG. 1, and consequently holds the coil spring 8 by a form locking, torsion-resistant fit on the housing hub 17. Here the diameter of the hollow cylindrical element of the housing hub 17 and the lateral length of the hollow square 25 of the housing hub 17 are constructed identically and approximately correspond to the diameter of the screw head of the central screw with which the housing hub 17 and the output unit 5 are screwed on the camshaft. The outer end 9 of the coil spring 8 is, in contrast, as likewise shown in FIG. 1, constructed with a hook-like shape and fastened in a form-locking manner at a suspension point projecting away axially on the drive unit 4 which in the device 1 illustrated is formed by an extended fastening screw 27 for the lateral cover 2, 3.

Through the enlarged representation of detail X in FIG. 3, it is also clear that the external pressure medium leakages of device 1 are selectively divertable through slot seals, not illustrated in greater detail, between the drive unit 4 and the outlet unit 5 to a coaxial opening 28 in the side cover 2 of the drive unit 4 adjacent to the housing 11, where they are introduced through an annular slot 29 between the opening 28 and the housing hub 17 into the annular space 12 of the housing 11. If the annular space 12 is then completely filled with the pressure medium leakage and if all of the spring turns 13 of the coil spring 8 are enclosed by the hydraulic pressure medium, sympathetic resonant vibrations of the coil spring 8 are damped, and the further following pressure medium is carried off through a further annular slot 30 between the housing cover 14 and the housing hub 17 out of annular space 12 as pressure medium leakage.

Reference Number List

1 Device
2 Side cover
3 Side cover
4 Drive unit
5 Output unit
6 Pressure chamber
7 Pressure chamber
8 Coil spring
9 one end
10 the other end
11 Housing
12 Annular space
13 Spring turns
14 Housing cover
15 Base
16 Circular opening
17 Housing hub
18 Circumferential wall
19 Edge part
20 Step
21 Detents
22 Cylinder wall
23 Bend
24 one face
25 Hollow square
26 the other face
27 Fastening screw
28 Opening
29 Annular slot
30 Additional annular slot
31 Entrance

What is claimed is:

1. Device for altering control times of gas exchange valves of an internal combustion engine for hydraulic rotational angle adjustment of a camshaft relative to a crankshaft, wherein the device is arranged on a drive side end of a camshaft mounted in a cylinder head of the internal combustion engine and is constructed as a hydraulic actuator controllable as a function of various operating parameters of the internal combustion engine, the device comprising:

a drive unit connected with the crankshaft and bounded axially by two lateral covers and an output unit non-rotatably connected with the camshaft and inserted into the drive unit;

the drive unit being in power transmitting connection with the output unit through at least two pressure chambers formed inside the device, alternatively or simultaneously acted upon by a hydraulic pressure medium;

control of pressure in the pressure chambers takes place under constant compensation for external pressure medium leakages to provide a relative rotation or a hydraulic clamping of the output unit in relation to the drive unit;

a spring apparatus on the device for adjustment of a speed of the device in both adjustment directions and for attaining a preferred position of the output unit relative to the drive unit for starting of the internal combustion engine;

the spring apparatus includes a coil spring arranged outside the device in front of an adjacent one of the lateral covers of the drive unit, that is fastened with one end on the drive unit as well as with an other end on the output unit;

the coil spring is enclosed by an additional housing that forms a closed annular space jointly with the adjacent lateral cover of the drive unit;

the closed annular space is fillable with the external pressure leakages of the device and the hydraulic pressure medium is divertable out of the closed annular space again as leakage;

whereby when the annular space is completely filled, the hydraulic pressure medium acts as a damping agent against sympathetic resonance of the spring turns of the coil spring resulting from vibrations of the internal combustion engine.

2. Device according to claim 1, wherein the additional housing comprises a cup-like housing cover with a coaxial circular opening in a base thereof, and of a casing-like housing hub insertable into the circular opening.

3. Device according to claim 2, wherein the cup-like housing cover includes a circumferential wall and an internal diameter approximately corresponding to an outside diameter of the adjacent side cover of the drive unit and is affixable through a lengthened edge part of the circumferential wall on the side cover.

4. Device according to claim 3, wherein the housing cover is centered with a circular step with a reduced diameter in the circumferential wall and is fastened in a form-locking manner through several detents distributed circumferentially in an edge part of the circumferential wall which extend behind the lateral cover.

5. Device according to claim 2, wherein the casing-like housing hub has a cylindrical wall with an outer diameter corresponding approximately to an internal diameter of the circular opening in the housing cover and is affixable with a radially outward directed bend on one face to the output unit.

6. Device according to claim 5, wherein the housing hub is attached via a central screw through a face side bend thereof together with the output unit onto the camshaft and the cylindrical wall is in part formed as a hollow square on which a complementarily constructed inner end of the coil spring is fastened in a form-locking manner.

7. Device according to claim 1, wherein the other end of the coil spring is formed with a bent hook-like shape and fastened in a form-locking manner on a suspension point projecting axially away on the drive unit.

8. Device according to claim 1, wherein the external pressure medium leakages of the device are selectively divertable through slot seals between the drive unit and the output unit to a coaxial opening in the lateral cover of the drive unit adjacent to the housing, and are introducible into the annular space of the housing through an annular slot between the opening as well as divertable out of this again through an additional annular slot between the housing cover and the housing hub.

* * * * *